United States Patent [19]

Bottiglieri

[11] 4,380,976

[45] Apr. 26, 1983

[54] FUEL FLOW ARRESTOR

[76] Inventor: Peter Bottiglieri, Box 85, Coal Harbour, B.C., Canada, V0N 1K0

[21] Appl. No.: 198,710

[22] Filed: Oct. 20, 1980

[51] Int. Cl.[3] ..... F02D 17/02

[52] U.S. Cl. ..... 123/198 DB; 123/338; 123/397

[58] Field of Search ..... 123/457, 459, 198 DB, 123/338, 397

[56] References Cited

U.S. PATENT DOCUMENTS

| | | | |
|---|---|---|---|
| 2,734,496 | 2/1956 | Hammond | 123/198 DB |
| 2,840,064 | 6/1958 | Hofer | 123/198 DB |
| 3,119,381 | 1/1964 | Cummins | 123/457 |
| 3,699,939 | 10/1972 | Eckert et al. | 123/459 |

FOREIGN PATENT DOCUMENTS

| | | | |
|---|---|---|---|
| 953915 | 2/1964 | United Kingdom | 123/459 |

*Primary Examiner*—Ira S. Lazarus
*Attorney, Agent, or Firm*—Klarquist, Sparkman, Campbell, Leigh, Whinston & Dellett

[57] ABSTRACT

An emergency shutdown device for an internal combustion engine, especially a fuel-injected diesel engine. In addition to shutting off the flow of fuel to the engine, the device "suspends" fuel within the engine fuel supply system to prevent it from passing into the engine combustion chambers. The device provides a controllable vacuum means which, by preventing fuel passage into the fuel injector pumps, quickly "starves" the engine of its fuel supply.

13 Claims, 2 Drawing Figures

FUEL FLOW ARRESTOR

FIELD OF THE INVENTION

This invention relates to emergency shutdown devices ("fuel flow arrestors") for internal combustion engines, especially fuel-injected diesel engines. In particular, the invention relates to fuel flow arrestors which not only shut off the flow of fuel to the engine but also restrain the passage of fuel into the engine combustion chambers.

BACKGROUND OF THE INVENTION

One type of fuel flow arrestor (also known as an "overspeed governor" or "overspeed trip") for a diesel engine comprises a manually or automatically actuated valve for interrupting the flow of fuel to the fuel injectors which distribute fuel into the engine combustion chambers. The object of the valve is to "starve" the engine of its fuel supply if the engine enters an overspeed condition—the theory being that the engine will eventually run out of fuel and come to a stop, thus preventing possible damage to the engine. A disadvantage of such valves is that they only prevent the flow of *additional* fuel to the injectors which distribute fuel into the engine combustion chambers.

The fuel supply system for a large industrial diesel engine may include one or more fuel injectors for spraying fuel into each engine combustion chamber, an individual high pressure pump for supplying fuel to each fuel injector, a fuel supply gallery for supplying fuel to the high pressure pumps, and a conduit for conveying fuel from the engine fuel pump to the fuel supply gallery. "Valve" type fuel flow arrestors, as described above, are typically positioned in the conduit between the engine fuel pump and the fuel supply gallery. Accordingly, even after the valve is closed, a relatively large amount of fuel may remain in the high pressure pumps, the fuel supply gallery and the conduit. This remaining fuel will be sprayed by the injectors into the engine combustion chambers even though the valve has been closed. The remaining fuel (which may be as much as 2 pints) may be adequate to keep the engine running for as long as 5 minutes. If the engine has entered an overspeed condition, additional operation of the engine without any applied load may very quickly result in serious damage to the engine.

A second type of fuel flow arrestor comprises a control rod which is mechanically linked to each of the engine fuel injectors and which may be selectably positioned to vary the amount of fuel passing through the fuel injectors. If the engine enters an overspeed condition the control rod may be positioned to prevent the passage of additional fuel through the fuel injectors, again "starving" the engine of its fuel supply. However, the linkages which connect the control rod to the fuel injectors have been prone to jamming, which may inhibit positioning of the control rod to prevent additional fuel passing through the injectors, enabling the engine to run out of control.

An object of the present invention is to provide a fuel flow arrestor for an internal combustion engine which operates not only to shut off the flow of fuel from the engine fuel pump to the engine, but also restrains passage of fuel into the engine combustion chambers. In accordance with this object, the engine may be stopped very quickly because fuel which has accumulated in the engine fuel supply system is not permitted to enter the combustion chambers at all.

SUMMARY OF THE INVENTION

The invention is directed to a fuel flow arrestor for an internal combustion engine. The arrestor comprises controllable vacuum means for suspending fuel within the engine fuel system. The arrestor may include a first valve which is normally open to enable fuel to flow to the combustion chamber and which is closeable to stop fuel flow to the combustion chamber. Preferably, the vacuum means comprises a second normally closed valve which may be opened to connect an inlet port of the engine fuel pump to the fuel inlet port of the combustion chamber. A third valve which is normally open to enable fuel to flow to the fuel pump and which may be closed to stop fuel flow to the pump may be provided. A fourth normally closed valve which may be opened to divert fuel flow from the pump to a fuel reservoir may be provided. Typically, the engine may include a fuel distribution means for distributing fuel into the engine combustion chambers. A fifth valve which is normally open to enable fuel to return from the distribution means to the reservoir and which may be closed to stop fuel return from the distribution means to the reservoir may also be provided. If all five valves are provided, then the first, third and fifth valves may be closed as the second and fourth valves are opened, thereby (a) stopping fuel return from the distribution means to the reservoir;
(b) diverting fuel flow from the pump to the reservoir;
(c) stopping fuel flow to the pump;
(d) connecting the pump inlet port to the combustion chamber inlet port; and,
(e) stopping fuel flow to the combustion chamber.

In a particular embodiment, the invention is directed to a fuel flow arrestor for an internal combustion engine, which engine includes:

(a) a fuel supply reservoir;
(b) fuel distribution means for distributing fuel into a combustion chamber of the engine;
(c) a pump for pumping fuel from the reservoir to the distribution means; and,
(d) a conduit for returning excess fuel from said distribution means to said reservoir.

The arrestor includes a spool valve which comprises a hollow body having a first aperture for connection to the fuel outlet port of the reservoir, a second aperture for connection to the fuel inlet port of the pump, a third aperture for connection to the fuel outlet port of the pump, a fourth aperture for connection to the fuel inlet port of the distribution means, a fifth aperture for connection to the fuel outlet port of the distribution means and a sixth aperture for connection to the fuel inlet port of the reservoir. The spool valve also comprises a valve member slidably positionable within the hollow body whereby, a first position of the valve member enables fuel to flow from the reservoir through the pump and through the distribution means into the combustion chamber and whereby a second position of the valve member stops fuel flow from the reservoir to the pump, diverts fuel flow from the pump to the reservoir and couples the pump inlet port to the distribution means inlet port.

DETAILED DESCRIPTION OF THE PREFERRED EMBODIMENT

The preferred embodiment is described in the context of a Detroit Diesel series 149 engine. This engine has a fuel supply system which includes an individual high pressure pump for supplying fuel to each of the engine fuel injectors, and a fuel supply gallery for supplying fuel to the high pressure pumps. However, the invention is of general application and may be adapted for use with other types of engine.

Figure 1:
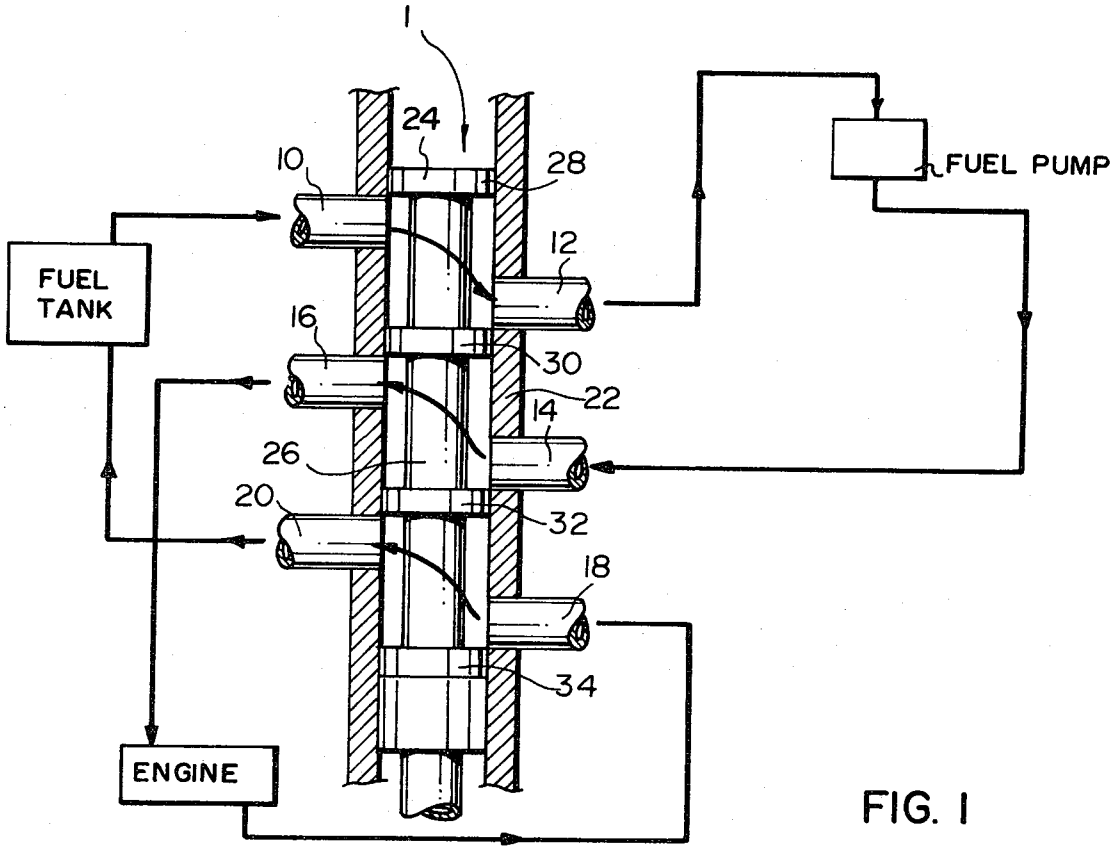
FIG. 1 is a block diagram depicting operation of a preferred embodiment of the fuel flow arrestor in the "run" mode of operation.
Figure 2:
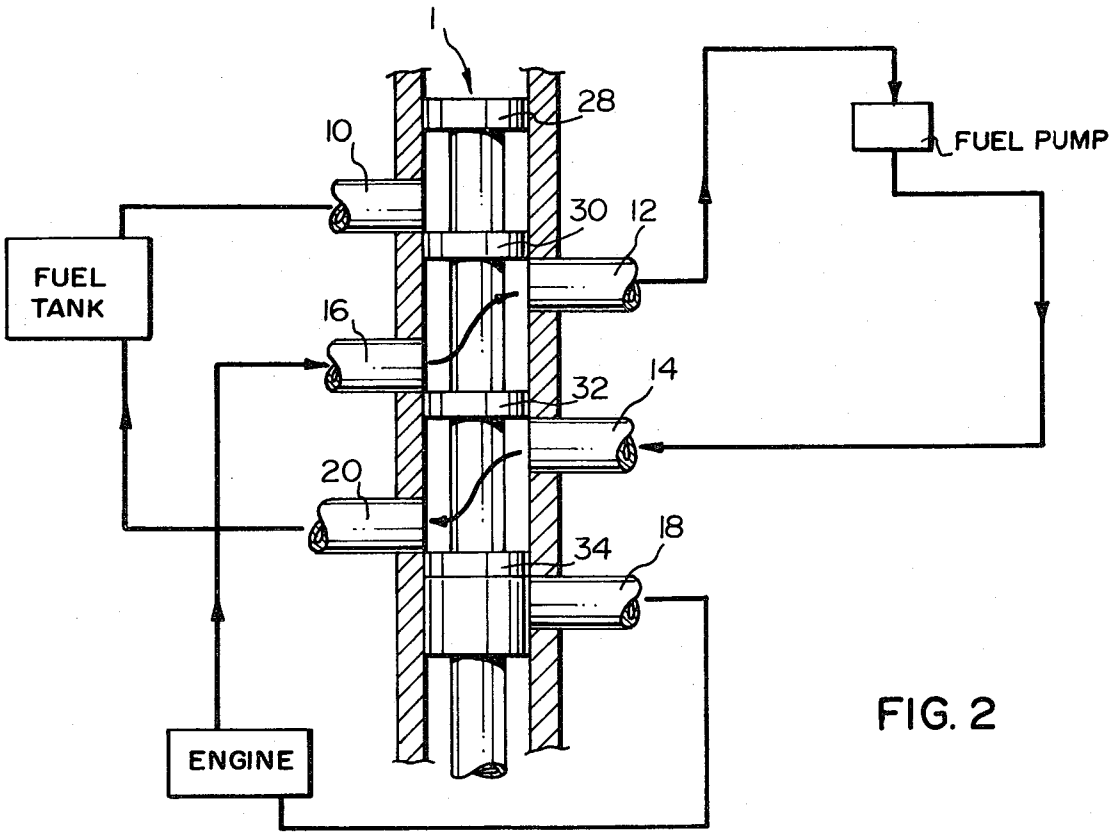
FIG. 2 is a block diagram depicting operation of a preferred embodiment of the fuel flow arrestor in the "shutdown" mode of operation.

FIGS. 1 and 2 depict in block diagram form some of the basic components for the fuel system of an internal combustion diesel engine. The fuel system typically includes a fuel tank for storing fuel and a fuel pump for pumping fuel from the fuel tank to the engine. The engine includes a fuel distribution means which, in the case of a high compression diesel engine, may comprise one or more fuel injectors for spraying fuel into each of the engine combustion chambers. As mentioned above, the fuel distribution means for a Detroit Diesel series 149 diesel engine also includes a high pressure fuel supply pump for each of the fuel injectors and an engine fuel supply gallery which serves as a fuel reservoir for the high pressure pumps. A conduit is provided for returning excess fuel from the engine fuel supply gallery to the fuel tank.

In operation, the fuel pump (which is typically a constant delivery type pump) pumps fuel from the fuel tank into the engine fuel supply gallery so that the fuel supply gallery is continually filled with fuel. The high pressure pumps are controlled to pass the proper quantity of fuel under high pressure to the fuel injectors for spraying into the engine combustion chambers.

The Detroit Diesel series 149 diesel engine includes a junction block which couples a fuel supply line from the fuel pump to the engine fuel supply gallery, and which couples a fuel return line from the engine fuel supply gallery to the fuel tank.

FIG. 1 depicts a specific embodiment of the fuel flow arrestor of the present invention which is designed to replace the aforementioned junction block of the Detroit Diesel series 149 engine. FIG. 1 depicts the fuel flow arrestor in its "run" mode of operation. The fuel flow arrestor comprises a "spool" type valve 1 having a number of inlet and outlet ports which are coupled to the engine fuel system fuel delivery lines. As shown in FIG. 1, spool valve 1 has a first aperture 10 for connection to the fuel tank fuel outlet port, a second aperture 12 for connection to the fuel pump fuel inlet port, a third aperture 14 for connection to the fuel pump fuel outlet port, a fourth aperture 16 for connection to the engine fuel supply gallery fuel inlet port, a fifth aperture 18 for connection to the engine fuel supply gallery fuel outlet port and a sixth aperture 20 for connection to the fuel tank fuel inlet port.

Spool valve 1 comprises a cylindrically apertured valve body 22 and a valve member 24 which may be slidably positioned within valve body 22 between the "run" position shown in FIG. 1 and the "shutdown" position shown in FIG. 2. Valve member 24 comprises a shaft 26 having four circular discs 28, 30, 32 and 34 rigidly affixed thereto. The discs are sized to permit slidable movement of valve member 24 within valve body 22 while preventing fuel passage between the circumference of each disc and valve body 22.

Disc 32 serves as a "first" valve which is normally open as shown in FIG. 1 to enable fuel passage from the fuel pump through apertures 14 and 16 to the engine fuel supply gallery. When valve member 24 is moved to its "shutdown" position as shown in FIG. 2, disc 32 is positioned to prevent fuel passage between apertures 14 and 16 thus stopping the flow of fuel to the engine fuel distribution means. Disc 32 is thus more or less equivalent to the single valve type fuel flow arrestor discussed above.

Disc 30 comprises a "second" valve which is normally closed as shown in FIG. 1 to prevent fuel passage between apertures 12 and 16. When valve member 24 is moved to its "shutdown" position as shown in FIG. 2, the "second" valve is opened to connect the fuel pump fuel inlet port to the engine fuel supply gallery fuel inlet port via apertures 12 and 16. In effect, this results in the application of a vacuum to the fuel supply gallery which restrains passage of fuel into the fuel injector pumps.

Disc 30 also serves as a "third" valve which is normally open as shown in FIG. 1 to enable the fuel pump to pump fuel from the fuel tank through apertures 10 and 12. When valve member 24 is moved to its "shutdown" position as shown in FIG. 2, disc 30 is positioned to prevent fuel passage between apertures 10 and 12 thus stopping the flow of fuel from the fuel tank to the fuel pump.

In addition to regulating fuel passage between the fuel pump and the engine fuel supply gallery, disc 32 also serves as a "fourth" valve which is normally closed as shown in FIG. 1 but which is opened when valve member 24 is in its "shutdown" position as shown in FIG. 2 to divert fuel flow from the fuel pump outlet port back to the fuel tank via apertures 14 and 20. This is important because the fuel pump continues to operate even when the fuel flow arrestor is in its "shutdown" position and accordingly any fuel which leaves the fuel pump must be stored somewhere.

Disc 34 comprises a "fifth" valve which is normally open as shown in FIG. 1 to enable excess fuel to be returned from the engine fuel supply gallery to the fuel tank via apertures 18 and 20. When valve member 24 is moved to its "shutdown" position as shown in FIG. 2, disc 34 is positioned to prevent fuel in the engine fuel supply gallery from draining back into the fuel tank via apertures 18 and 20. If the engine fuel supply fuel gallery were drained of fuel then it would be necessary to prime the engine fuel system before the engine could be restarted, which is a relatively inconvenient and time consuming procedure.

Disc 34 is also believed to assist in restraining the passage of fuel into the fuel injector pumps when the fuel flow arrestor is in the "shutdown" position. Although not wanting to be bound by any theory, the inventor believes that the positioning of disc 30 to couple the fuel pump fuel inlet port to the engine fuel supply gallery fuel inlet port subjects fuel in the engine fuel supply gallery to a force which is negative with respect to the forces tending to draw fuel into the high pressure pumps. However, if disc 34 were not provided, then in a "shutdown" condition the fuel pump might simply pump fuel out of the engine fuel supply gallery without generating forces sufficient to offset the forces tending to draw fuel into the high pressure pumps. It is this "offset force" which is believed to enable rapid shutdown of the engine—only a very small quantity of fuel accumulated within the high pressure pumps will be able to pass into the engine combustion chambers. The bulk of the fuel remaining in the fuel system will be restrained from passage into the combustion chambers.

Disc 28 simply serves as a stop to constrain fuel entering valve body 22 via aperture 10 within the valve body.

The spool valve described above provides a convenient, compact structure which may be interconnected to the engine fuel delivery lines to attain the objectives of the invention in a relatively simple manner. It will readily occur to those skilled in the art, however, that the functions described above may be achieved by replacing each "valve" with an individual valve member—all of which valve members may be actuated in unison to accomplish the objectives of the invention. In addition, it will readily occur to those skilled in the art that automatic means may be provided for moving valve member 24 from the "run" to the "shutdown" position. However, the decision to use manual or automatic control will depend upon each individual user and the perceived reliability of the automatic overspeed sensing and control mechanism used. Since the fuel flow arrestor is intended to be a "last resort" emergency shutdown device for preventing damage to an engine which may enter an overspeed condition, it would seem reasonable to provide a relatively rugged manually operated spool valve structure for the engine operator to activate rather than to rely upon an automatic sensing and control mechanism which might possibly fail at the moment it is needed—perhaps even as a result of conditions which may send the engine into an overspeed condition in the first place.

It has been found that a fuel flow arrestor embodying a spool valve as described above is capable of shutting down a 1,000 horsepower Detroit Diesel Series 149 diesel engine running at 1,750 rpm (without flywheel) in 3½ seconds.

I claim:

1. A fuel flow arrestor for an internal combustion engine, said engine including a pump for pumping fuel to an engine fuel distribution means, said arrestor comprising:

(a) a first valve normally open to enable fuel flow to a combustion chamber of said engine and closeable to stop fuel flow to said combustion chamber;

(b) a second normally closed valve for opening to connect an inlet port of said pump to an inlet port of said engine fuel distribution means;

(c) a third valve normally open to enable fuel flow from a fuel tank to said pump and closeable to stop fuel flow from said fuel tank to said pump;

(d) a fourth normally closed valve for opening to divert fuel flow from an outlet port of said pump to said fuel tank; and, (e) a fifth valve normally open to enable fuel return from said engine fuel distribution means to said fuel tank and closeable to stop fuel return from said engine fuel distribution means to said fuel tank.

2. A fuel flow arrestor as defined in claim 1, wherein said first, third and fifth valves are closed as said second and fourth valves are opened, thereby (a) stopping fuel return from said engine fuel distribution means to said fuel tank;

(b) diverting fuel flow from an outlet port said pump to said fuel tank;

(c) stopping fuel flow from said fuel tanks to said pump;

(d) connecting said pump inlet port to said engine fuel distribution means fuel inlet port; and, (e) stopping fuel flow to said engine fuel distribution means.

3. A fuel flow arrestor for an internal combustion engine, said engine including:

(a) a fuel tank;

(b) fuel distribution means for distributing fuel into a combustion chamber of the engine;

(c) a pump for pumping fuel from said fuel tank to said distribution means; and, (d) a conduit for returning excess fuel from said distribution means to said fuel tank;

said arrestor comprising controllable vacuum means for suspending fuel within the engine fuel system.

4. A fuel flow arrestor as defined in claim 3, which includes a first valve normally open to enable fuel flow from said pump to said distribution means and closeable to stop fuel flow from said pump to said distribution means.

5. A fuel flow arrestor as defined in claim 4, wherein said vacuum means comprises a second normally closed valve for opening to connect an inlet port of said pump to the fuel inlet port of said distribution means.

6. A fuel flow arrestor as defined in claim 5, further including a third valve normally open to enable fuel flow from said fuel tank to said pump and closeable to stop fuel flow from said fuel tank to said pump.

7. A fuel flow arrestor as defined in claim 6, further including a fourth normally closed valve for opening to divert fuel flow from an outlet port of said pump to said fuel tank.

8. A fuel flow arrestor as defined in claim 7, further including a fifth valve normally open to enable fuel return from said distribution means to said fuel tank and closeable to stop fuel return from said distribution means to said fuel tank.

9. A fuel flow arrestor as defined in claim 5, wherein said second valve is opened as said first valve is closed, thereby (a) connecting said pump inlet port to said fuel distribution means fuel inlet port; and, (b) stopping fuel flow to said distribution means.

10. A fuel flow arrestor as defined in claim 6, wherein said first and third valves are closed as said second valve is opened, thereby (a) stopping fuel flow from said fuel tank to said pump;

(b) connecting said pump inlet port to said fuel distribution means fuel inlet port; and, (c) stopping fuel flow to said distribution means.

11. A fuel flow arrestor as defined in claim 7, wherein said second and fourth valves are opened as said first and third valves are closed, thereby (a) diverting fuel flow from an outlet port of said pump to said reservoir;

(b) stopping fuel flow from said fuel tank to said pump;

(c) connecting said pump inlet port to said distribution means fuel inlet port; and, (d) stopping fuel flow to said distribution means.

12. A fuel flow arrestor as defined in claim 8, wherein said first, third and fifth valves are closed as said second and fourth valves are opened, thereby (a) stopping fuel return from said distribution means to said fuel tank;

(b) diverting fuel flow from an outlet port of said pump to said fuel tank;

(c) stopping fuel flow from said tank to said pump;

(d) connecting said pump inlet port to said distribution means fuel inlet port; and, (e) stopping fuel flow to said distribution means.

13. A fuel flow arrestor for an internal combustion engine, said engine including:

(a) a fuel tank;

(b) fuel distribution means for distributing fuel into a combustion chamber of the engine;

(c) a pump for pumping fuel from said fuel tank to said distribution means; and, (d) a conduit for returning excess fuel from said distribution means to said fuel tank; said arrestor comprising a spool valve comprising a hollow body having a first aperture for connection to the fuel outlet port of said fuel tank, a second aperture for connection to the fuel inlet port of said pump, a third aperture for connection to the fuel outlet port of said pump, a fourth aperture for connection to the fuel inlet port of said distribution means, a fifth aperture for connection to the fuel outlet port of said distribution means and a sixth aperture for connection to the fuel port of said fuel tank, said spool valve including a valve member slidably positionable within said body whereby, a first position of said valve member enables fuel flow from said fuel tank through said pump and through said distribution means into said combustion chamber and whereby a second position of said valve member stops fuel flow from said fuel tank to said pump, diverts fuel flow from said pump to said fuel tank and couples said pump inlet port to said distribution means inlet port.

* * * * *